US006464207B2

(12) United States Patent
Creel et al.

(10) Patent No.: US 6,464,207 B2
(45) Date of Patent: Oct. 15, 2002

(54) MOTORCYCLE LIFT AND STAND APPARATUS

(76) Inventors: Sherri L. Creel, 1925 SW. Americana St., Port St. Lucie, FL (US) 34953; Tommy C. Creel, 1925 SW. Americana St., Port St. Lucie, FL (US) 34953

( * ) Notice: Subject to any disclaimer, the term of this patent is extended or adjusted under 35 U.S.C. 154(b) by 0 days.

(21) Appl. No.: 09/783,519

(22) Filed: Feb. 15, 2001

(65) Prior Publication Data

US 2002/0113230 A1 Aug. 22, 2002

(51) Int. Cl.[7] ..... B66F 3/00

(52) U.S. Cl. ..... 254/131; 254/10 C; 254/8 C; 254/134

(58) Field of Search ..... 254/131, 133 R, 254/120, 8 C, 10 R, 10 B, 134, 10 C

(56) References Cited

U.S. PATENT DOCUMENTS 4,723,756 A * 2/1988 Stumpf, Jr. ..... 254/134
5,518,224 A * 5/1996 Anderson ..... 254/131
5,769,396 A * 6/1998 Tischendorf ..... 254/131
5,979,878 A * 11/1999 Blankenship ..... 254/131

* cited by examiner

*Primary Examiner*—Joseph J. Hail, III
*Assistant Examiner*—Lee Wilson
(74) *Attorney, Agent, or Firm*—A. James Valliere

(57) ABSTRACT

A motorcycle lift and stand apparatus for manually lifting and supporting a motorcycle in an elevated position for cleaning or other maintenance. The motorcycle lift and stand apparatus is a collapsible support system which can be quickly and easily raised from a storage position to an operational position by the use of a lever arm. Operation of the lever arm easily lifts an entire motorcycle into a raised position above a ground plane. The apparatus has a cycle support surface formed by two cylinders spaced apart by rigid members and a pair of upright support units. The lever arm is affixed to one of the upright support units such that when the arm is lowered, the upright support units raise the cycle support surface from the ground plane position to an elevated position with sufficient force to lift the motorcycle. The upright support units each have a cylindrical bearing which is rotatably positioned within the respective cylinders of the cycle support surface, and the units are slidably connected together by a retention bracket. This allows the entire apparatus to be raised in such a way that the upright support units maintain a substantially parallel relationship to each other, which in turn allows the cycle support surface to be raised substantially parallel to the ground plane for the most effective lifting motion.

15 Claims, 3 Drawing Sheets

MOTORCYCLE LIFT AND STAND APPARATUS

BACKGROUND OF THE INVENTION

The present invention relates to devices for lifting motorcycles and holding them in an elevated position for cleaning or other maintenance.

Unlike automobiles much of the maintenance of a motorcycle is performed by the owner in a home garage, for instance. However, unlike a bicycle, a motorcycle can weigh hundreds of pounds and cannot be easily lifted without specially designed equipment.

Various systems have been invented to aid in the process of lifting a motorcycle. A system using a crank to rotate a lifting bar in shown in U.S. Pat. No. 5,639,067. However this system is not easily operated or stored.

Another type lifting system is shown in U.S. Pat. No. 4,494,764, where a lifting mechanism is permanently mounted on the bike. Operation requires leaning the cycle to get it into an elevated position.

Yet another type of device uses the forward momentum of the bike to actuate a lifting mechanism as shown in U.S. Pat. No. 5,979,878.

Other devices are shown in U.S. Pat. Nos. 4,723,756 and 5,927,689.

However, none of these devices have the ease of operation and storage which are features exhibited by the device of the present invention. The lift and stand apparatus of the present invention can lift a heavy motorcycle with ease, move it into an elevated position with both wheels off the ground, and hold it in that position with the stability required for normal maintenance.

SUMMARY OF THE INVENTION

According to the invention, a motorcycle lift and stand apparatus comprises a cycle support surface formed of two cylinders held apart in parallel relationship to each other. Two upright support units are used to raise and lower the support surface from a ground plane to engage the underside of a motorcycle.

The upright support units each have a bearing cylinder which is rotatably mounted within the two cylinders of the cycle support surface. A retention bracket ties the two upright support units together and restricts their pivotal movement so that the raising of one of those units effective simultaneously raises the other. As the two upright support units pivot to an upright position, they carry the cycle support surface upwardly substantially horizontally to engage the motorcycle. This action is accomplished by the use of a lever arm attached to one of the upright support units. By forcing the lever arm downwardly to ground level, the cycle is lifted and simultaneously moved rearwardly toward the lever arm. When the arm is in the rest position, the upright support units have moved past the vertical position to form an angle of less than 90 degrees with the ground plane. This over center action allows the weight of the cycle to bear on the lever arm, which in turn is rested on the ground plane, providing the required stability to the cycle and stand. The lever arm is rotatably attached, and the entire apparatus can be collapsed into a storage position requiring minimal storage space.

Accordingly, it is an object of this invention to provide a motorcycle lift and stand apparatus which is simple in design and which can readily and easily lift a heavy motorcycle and maintain it in a stable elevated position for maintenance or other purposes.

It is another object of this invention to provide a motorcycle lift and stand apparatus which is capable of lifting both wheels of a motorcycle simultaneously off a ground plane and supporting the entire cycle in an elevated and stable position for maintenance.

It is yet another object of this invention to provide a motorcycle lift and stand apparatus which is simple in construction, manual in operation, low in cost, and efficient to store.

DESCRIPTION OF THE PREFERRED EMBODIMENT

The present invention relates to a lift and stand apparatus for readily and easily lifting and supporting a motorcycle in an elevated position for cleaning, inspection, mechanical maintenance or other purposes. The apparatus as described herein is simple in construction, low in cost, non-electrical, non-hydraulic, powered without the use of springs, easy to store and quickly and easily put into use for lifting an entire motorcycle at one stroke of a lever arm.

Figure 1:
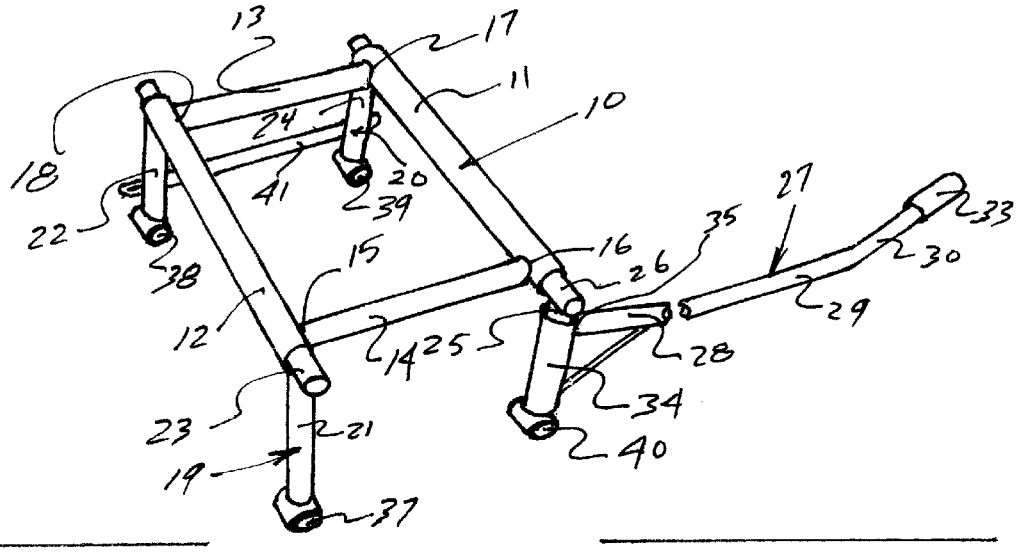
FIG. 1 is a perspective view of the motorcycle lift and stand apparatus of this invention in its fully operational position.

An apparatus according to the present invention is illustrated in FIG. 1 where the device is shown in its fully elevated position.

The apparatus has a cycle support surface designated generally by the numeral 10. The cycle support surface 10 is the surface that actually contacts the underside of the motorcycle during the lifting process and is formed of a pair of relatively large cylinders 11 and 12 which are joined together in rectilinear form by connecting pieces 13 and 14. All four members, 11, 12, 13 and 14 may be formed of steel pipe, for example, and rigidly welded together at joints 15, 16, 17 and 18. The entire cycle support surface may be coated with a durable finish to prevent abrasion in the lifting process, as further explained herein.

The apparatus has two upright support units designated generally by the numerals 19 and 20.

These upright support units are also formed of cylindrical material, preferably steel, and comprise three basic components. They are, in the case of the upright support unit 19, two legs, 21 and 22 and a bearing 23. The three pieces, 21, 22, and 23 are welded together to be integral, and the bearing 23 is permanently and rotatably mounted interiorly of and concentrically with the relatively large cylinder 12. The bearing 23 may be formed of a steel pipe of an outer diameter, which is slightly smaller than the inner diameter of the relatively large cylinder 12.

The opposing upright support unit 20 is constructed identically to the unit 19 of comparable members, 24, 25, and 26.

This construction allows both upright support units to rotate freely around the centerline of their respective bearing 23 and 26, which in turn allows the cycle support surface 10 to occupy any angle with respect to the upright supports.

Absent any further components, therefore, the cycle support surface 10 could be lowered to be flat against a ground plane or raised to an upright position in which it is substantially parallel to the ground plane. This latter position is the position of maximum lift.

The raising of the support surface 10 with sufficient force to lift a heavy motorcycle is accomplished by the use of a lever arm designated generally by the numeral 27. This lever arm 27 is used to pivot the upright support unit 20 and hence raise or lower the cycle support surface 10.

The lever arm 27 comprises three segments, a lever segment 28, a support segment 29 and a handle segment 30. All three segments are joined together at points 31 and 32. While all three segments act as a lever during the lifting or lowering of a motorcycle, the support segment has an additional function of providing extended support to bear the weight of the motorcycle as to be further explained. The lever arm 27 may be formed of a steel cylinder or pipe and bent at points 31 and 32 to form the segments 28, 29, and 30. A grip handle 33, similar to a bicycle grip may be provided at the end of the handle segment to provide comfort to the user and give a better grip on the handle.

In the fully operational, (elevated) position, the support segment 29, is rested against the ground plane. This is accomplished by the user gripping the handle 33 and forcing it to the ground position which lifts the motorcycle by raising the cycle support surface 10. Note that the handle segment 30 is bent upwardly relative to the support segment 29 so that in operation, the hand of the operator is kept spaced from the ground plane.

The lever arm 27 is attached to the upright support unit 20 by way of a sleeve 34. The sleeve 34 is rotatably mounted over the leg 25, and the lever arm 27 is welded to the sleeve 34 at the point 35. A support piece 36 provides added strength to the junction of the lever arm 27 to the sleeve 34. The use of this sleeve 34 allows the lever arm to be used in the lifting operation and also rotated to a stored position as to be further described.

Each of the legs, 21, 22, 24, and 25 are provided with feet 37, 38, 39, and 40, which may be form of pipe segments with decorative caps fitted into the ends of the feet as shown.

As described to this point, the lever arm 27 can be raised or lowered, resulting in the raising or lowering of the support surface 10, which supports the motorcycle thereon.

However, this alone would leave the opposing upright support unit 19 to be freely rotatable about its bearing 23, thus affecting the stability of the entire apparatus.

To bring stability to the entire apparatus and cause both upright support units to act in cooperation with each other, a retention bracket 41 is provided. The bracket 41 pivotally and slidably connects the upright support units 19 and 20 to each in a way that allows the system to be freely lowered or raised in a stable manner.

Figure 4:
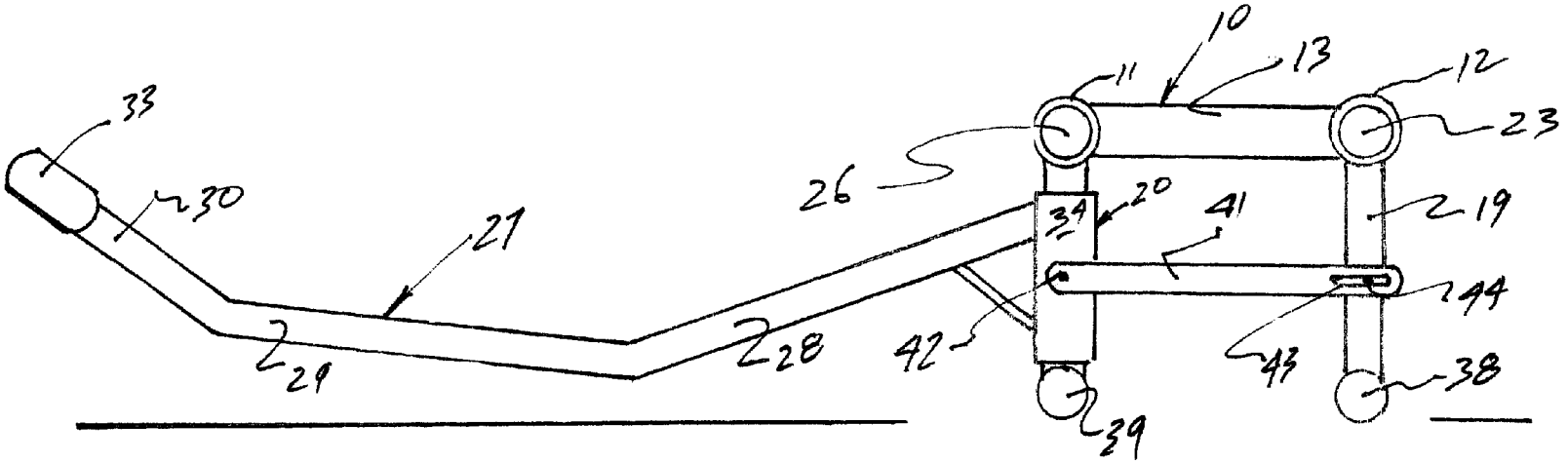
FIG. 4 is a side view of the motorcycle lift and stand apparatus of this invention which illustrates the relationship of the lever arm to the upright support unit to which it is attached, and further illustrates the use of the retention bracket which maintains a guided relationship between the various parts during movement from a collapsed to an upright operational position.

As best shown in FIG. 4, the retention bracket 41 is pivotally mounted to the upright support unit 20 at pivot point 42. The retention bracket 41 has an elongated slot 43 at its opposite end, which is mounted over a pin 44. The pin 44 has a large enough head to entrap the retention bracket 41 at the slot 43 and confine its movement to a back and forth sliding action about the pin.

Figure 2:
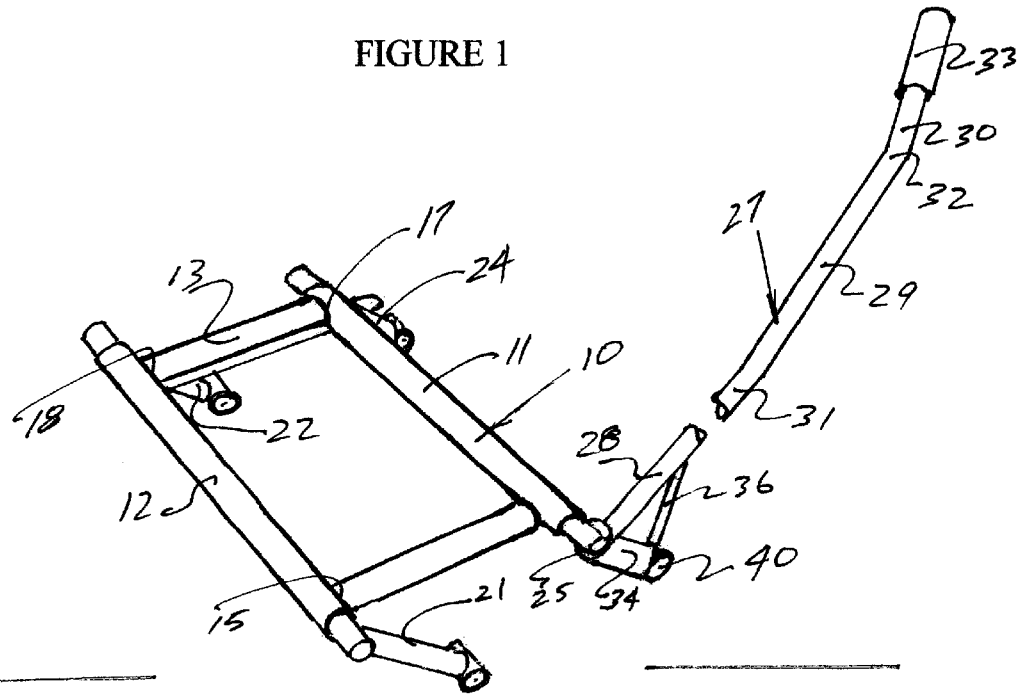
FIG. 2 is a perspective view of the motorcycle lift and stand apparatus of this invention showing its configuration while being raised from a collapsed storage position to its fully operational position.
Figure 3:
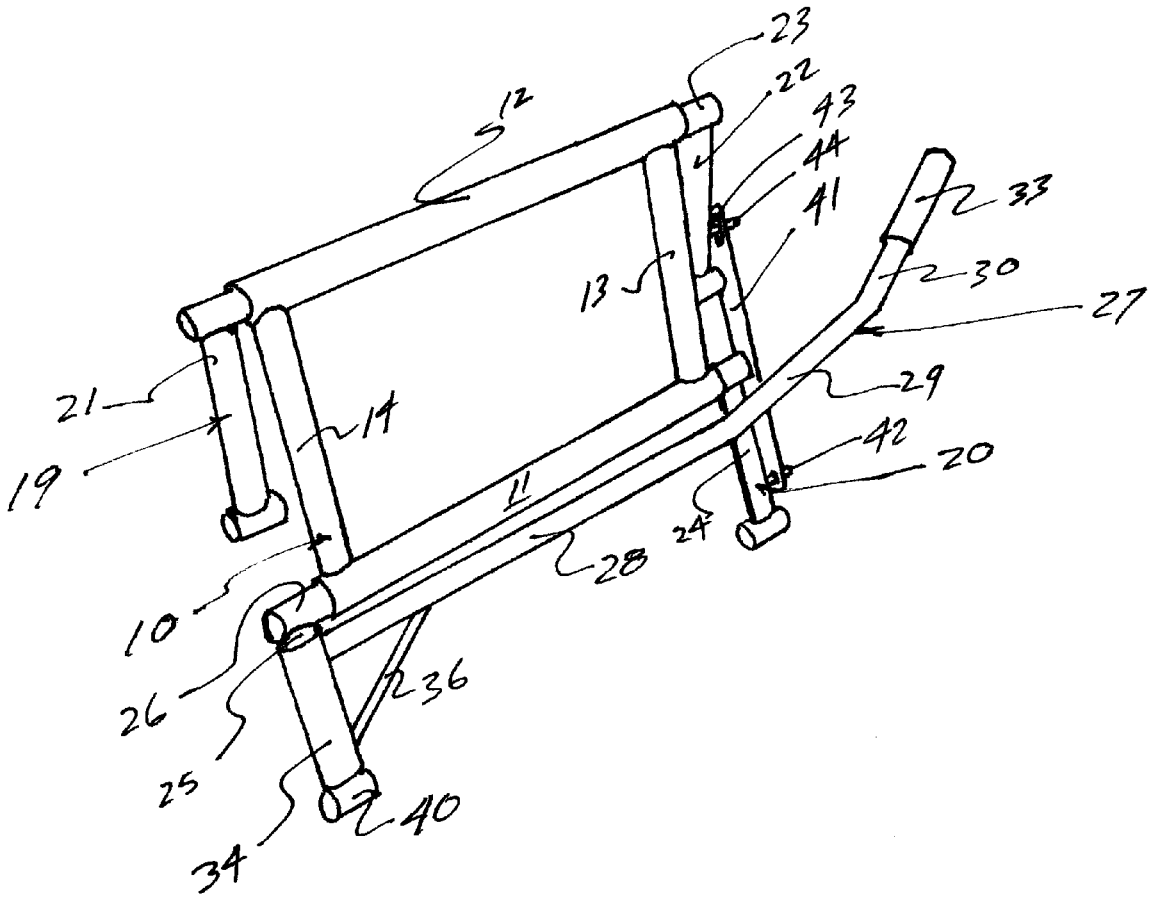
FIG. 3 is a perspective view of the motorcycle lift and stand apparatus of this invention showing its configuration while in the collapsed or storage position.

As can be visualized from FIG. 4, in conjunction with FIGS. 2 and 3, the raising or lowering of the lever arm 27 causes the accompanying action of the upright support unit 20, and, through the retention bracket, causes an associated movement of the upright support unit 19. As the apparatus is raised or lowered, the upright support units 19 and 20 are maintained in substantially parallel relationship with each other. Since it is clear that exact parallelism cannot be accomplished during this action, the slot 43 is of sufficient length to allow this action to take place.

Figure 5:
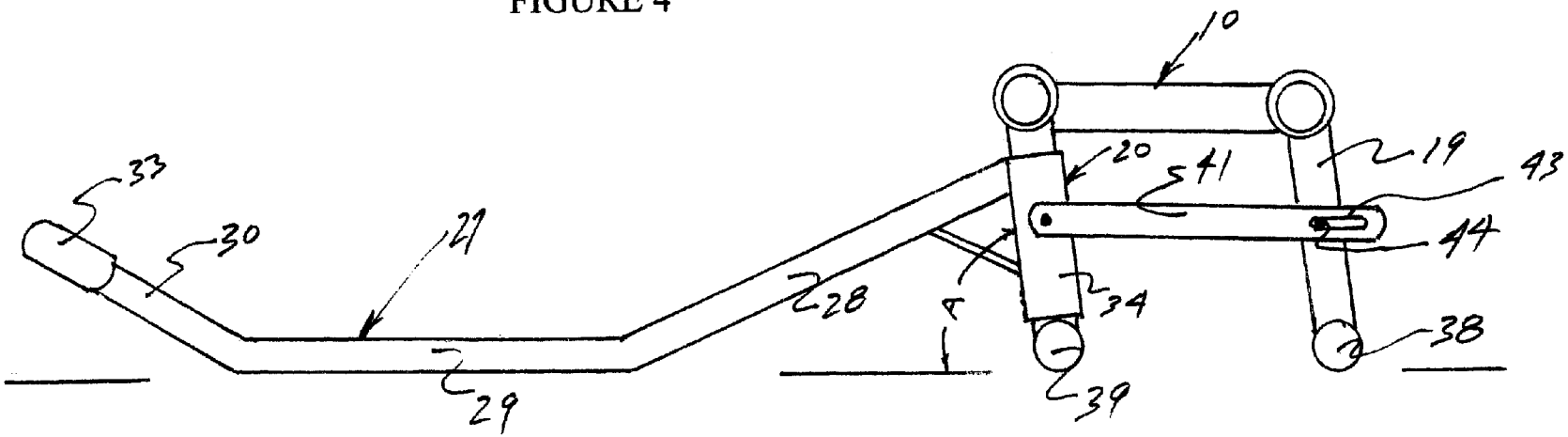
FIG. 5 is a side view similar to that of FIG. 4, showing the motorcycle lift and stand apparatus in the fully operational position.

The operation of the lift and stand apparatus of this invention can be understood by further consideration of FIGS. 2, 3, and 5.

FIG. 2 shows the lift and stand apparatus of this invention when it is at an engagement position. In particular, by lifting the lever arm 27 from the position shown in FIG. 1, both upright support units 19 and 20 are tilted to an angle substantially greater than 90 degrees with respect to the ground plane located beneath the lever arm. This action lowers the cycle support surface 10, but maintains it substantially parallel to the ground plane. At this lower level, the lift and stand can be slid underneath the motorcycle. Once under the motorcycle, the lever arm is then lowered to the position shown in FIG. 1, which lifts the cycle support surface and the motorcycle upwardly to a position where both wheels are lifted off the ground for maintenance or other action.

The operation of the motorcycle lift and stand can be further understood by referring to FIG. 5. The action of lowering the lever arm 27 from the position shown in FIG. 2 to the position shown in FIGS. 1 and 5, causes the cycle support surface to, first, be raised to a maximum height, when the upright support units 19 and 20 are vertical, and then to a slightly lower final height in the rest position.

This is caused by moving the entire mechanism to the over center position as shown in FIG. 5. In the over center position, which is the loaded and stable position, the upright support unit 20 forms an angle "A" with the subtended ground plane of less than 90 degrees. This shifts the weight to the support segment 29 of the lever arm 27. At this point, the operator can release the lever arm, and the apparatus together with its supported motorcycle is held in a stable position.

In addition to the above described attributes, the motorcycle lift and stand of this invention can be easily stored to occupy a minimum amount of space.

The lift and stand apparatus is shown in its fully collapsed or storage position in FIG. 3. Here, it can be seen that the slot 43 in the retention bracket 41 is long enough to allow the upright support units 19 and 20 to collapse, allowing the support surface 10 to likewise collapse into a nearly flat position. In the storage position, the lever arm 27 is rotated about the sleeve 34 to a similarly collapsed position where it is folded over and against the upright support unit 20.

The lift and stand apparatus described in FIGS. 1–5, is simple in construction, inexpensive to make, highly effective in supporting a motorcycle in an extremely stable position and readily collapsible for efficient storage.

We claim:

1. A motorcycle lift and stand apparatus comprising:

first and send upright support units;

a cycle support surface pivotally attached to and extending between respective ones of said upright support units;

a retention bracket having opposite ends respectively pivotally and slidably connecting said pair of upright support units to one another for maintaining a predetermined spaced apart relationship therebetween, and a lever arm rotatably attached to one of said pair of upright support units.

2. A motorcycle lift and stand apparatus in accordance with claim 1 wherein:

each of said first and second upright support units comprise a pair of spaced apart legs and an upper bearing connected between said legs, and said cycle support surface being pivotally attached to and between respective ones of said bearings.

3. A motorcycle lift and stand apparatus in accordance with claim 2 wherein:

said lever arm is rotatably connected to one of said legs of said upright support units.

4. A motorcycle lift and stand apparatus in accordance with claim 3 wherein:

a sleeve is rotatably mounted to one of said legs and said lever arm is rigidly attached to said sleeve, whereby said arm may be rotated to a position substantially perpendicular to its attached upright support unit for elevating and lowering said cycle support surface and also rotated to a position substantially parallel to said upright support unit for storage.

5. A motorcycle lift and stand apparatus in accordance with claim 4 wherein:

said retention bracket comprising a rigid member having a first end pivotally attached to one leg of one of said upright support units and having a second end slidably connected to an opposing leg of the other of said upright support units, whereby said upright support units may be moved to an upright position from a lowered stowage position while being retained in a Substantially parallel relationship with each other.

6. A motorcycle lift and stand apparatus in accordance with claim 5 wherein:

said second end of said rigid member of said retention bracket has an elongated slot, a pin mounted on said opposing leg, and said elongated slot slidably mounted over said pin to allow said upright support units to move in a generally parallel relation with respect to each other within the limits of said elongated slot.

7. A motorcycle lift and stand apparatus comprising first and second Upright support units, each having at least two legs and a relatively small cylindrical bearing connecting said legs at their upper ends;

a cycle support surface including at least two relatively large cylinders spaced apart to be substantially parallel to each other:

each of said relatively small cylindrical bearings being positioned interiorly of and concentrically with one of said relatively large cylinders of said cycle support surface and being freely rotatable therein;

a lever arm attached to one of said lets, whereby raising and lower said lever arm causes the bearings of both of said upright support units to pivot within said respective large cylinders to raise and lower said cycle support surface.

8. A motorcycle lift and stand apparatus in accordance with claim 7 wherein:

a retention bracket is provided to stabilize the relationship between said first and second upright support units;

said retention bracket being pivotally connected to one leg of said first upright support unit and slidably connected to an opposing leg of said other of said support units, thereby confining said upright support units to maintain a substantially parallel relationship with each other during pivotal movement caused by raising and lowering said lever arm.

9. A motorcycle lift and stand apparatus in accordance with claim 8 wherein:

said opposing leg has a midpoint between the ends thereof the point of slidable connection of said retention bracket to said opposing leg is below the midpoint of said leg.

10. A motorcycle lift and stand apparatus in accordance with claim 8 wherein:

said lever arm has at least two segments integrally and linearly joined to each other, the outer of the two segments being oriented to rest on the ground plane from which the motorcycle is being lifted when the motorcycle is in an elevated position, whereby the lever arm acts as a stabilizing means to support said lift and stand apparatus in an elevated position while holding the weight of a motorcycle thereon.

11. A motorcycle lift and stand apparatus in accordance with claim 8 wherein:

said lever arm is at least three times the height of said legs.

12. A lift and stand apparatus for and holding a motorcycle above a ground plane comprising:

first and second upright support units, each having at least two legs and a cylindrical bearing rigidly connected between said legs at their upper ends;

a rigid cycle support surface having two outer cylindrical members concentrically mounted exteriorly of said respective ones of said cylindrical bearings and being spaced apart from each other; said bearings of said first and second upright support units being rotatable with said outer cylindrical mends;

a retention bracket pivotally holding the legs of said first and second upright support units in a substantially parallel spaced relationship during rotation of said bearings within said outer cylindrical members; a lever arm having a lever segment, and a support segment;

the lever segment being rotatably attached at one end to one of said legs so as to be readily movable between operational and storage positions; said support segment being attached to the other end of the lever segment, and, said lever segment being attached in relation to said leg as to cause said leg to be inclined toward said arm at an angle of less than 90 degrees with the ground plane when the support segment of said arm is rested on said ground plane.

13. A lift and stand apparatus for lifting and holding a motorcycle above a ground plane in accordance with claim 12 wherein;

said retention bracket includes a rigid member pivotally connected to one leg of one of said first and second upright support units and slidably connected to an opposing leg of the other of said support units.

14. A lift and stand apparatus for lifting and holding a motorcycle above a ground plane in accordance with claim 12 wherein:

at least one of said legs is cylindrical;

a sleeve position so as to rotatable concentrically about said cylindrical leg;

said lever segment of said lever arm being attached to said sleeve.

15. A lift and stand apparatus for lifting and holding a motorcycle above a ground plane in accordance with claim 14 wherein:

said lever arm has a handle segment attached to the outer end of the support segment;

the support segment being oriented at an angle of less than 90 degrees with respect to the leg to which said lever segment is attached, and said handle segment being angled upwardly from the support segment to allow the hand of an operator to be spaced from the ground plane when the support segment is moved into contact with that plane.

* * * * *